US008739717B2

(12) United States Patent
Ellnor

(10) Patent No.: US 8,739,717 B2
(45) Date of Patent: Jun. 3, 2014

(54) OCEAN GOING TRANSPORT VESSEL WITH DOCKING ARRANGEMENTS

(76) Inventor: Piet Ellnor, East Fremantle (AU)

( * ) Notice: Subject to any disclaimer, the term of this patent is extended or adjusted under 35 U.S.C. 154(b) by 361 days.

(21) Appl. No.: 13/126,465

(22) PCT Filed: Oct. 27, 2009

(86) PCT No.: PCT/AU2009/001405

§ 371 (c)(1),
(2), (4) Date: Apr. 28, 2011

(87) PCT Pub. No.: WO2010/048665

PCT Pub. Date: May 6, 2010

(65) Prior Publication Data

US 2011/0203507 A1 Aug. 25, 2011

(30) Foreign Application Priority Data

Oct. 28, 2008 (AU) ..... 2008905560

(51) Int. Cl.
*B63B 1/00* (2006.01)

(52) U.S. Cl.
USPC ..... 114/61.22

(58) Field of Classification Search
USPC ..... 114/44, 45, 46, 48, 258, 61, 1, 2, 21, 114/22, 61.12, 61.13, 61.14, 61.22, 61.21, 114/61.2, 61.1
See application file for complete search history.

(56) References Cited

U.S. PATENT DOCUMENTS 3,835,802 A * 9/1974 Vernede et al. ..... 114/260
3,931,778 A * 1/1976 Miller et al. ..... 114/26
4,020,777 A 5/1977 Brown et al.
4,043,285 A * 8/1977 Nordstrom ..... 114/72
4,106,641 A 8/1978 Campbell et al.
4,135,468 A 1/1979 Kirby et al.
4,147,123 A 4/1979 Kirby et al.
4,150,635 A 4/1979 Lloyd, III et al.
4,165,702 A 8/1979 Lloyd, III et al.
4,207,828 A 6/1980 Horowitz et al.

(Continued)

FOREIGN PATENT DOCUMENTS

GB 1469373 4/1977
GB 2008652 4/2003

(Continued)

OTHER PUBLICATIONS

Frigg Area Cessation News; Jun. 2001 No. 3, Frigg Norway and UK; Totalfinaelf Exploration Norge as Information Department.

*Primary Examiner* — Stephen Avila
*Assistant Examiner* — Anthony Wiest

(57) ABSTRACT

An ocean going transport vessel 11 having a pair of hulls 13 15, supporting a first deck 17 located above and extending across the hulls 13 15 toward one end, and forming a structural link between the hulls 13 15. Each hull 13 15 includes a further deck 65 67 extending from the first deck 17 to the other end of the hulls 13 15. Ballast tanks allow adjustment of the draft and trim of the vessel 11. A void 115 extends between the further decks 65 67 and associated hulls 13 15 for stowage or suspension of a load, frame, or deck. The further decks 65 67 extend longitudinally beyond the hulls 13 15 as cantilevered decks 95 97 which each include a docking point 207 arranged to support the vessel by the cantilevered decks, by the docking point 207 resting on a structural support.

20 Claims, 17 Drawing Sheets

(56) References Cited

U.S. PATENT DOCUMENTS

| | | | | |
|---|---|---|---|---|
| 4,273,067 | A | 6/1981 | Lloyd, III et al. | |
| 4,361,104 | A | 11/1982 | Lloyd, III et al. | |
| 4,422,400 | A | 12/1983 | Burke | |
| 4,624,209 | A | 11/1986 | Loffler | |
| 4,860,681 | A | 8/1989 | Svenning | |
| 4,899,682 | A | 2/1990 | Pouget et al. | |
| 5,037,241 | A * | 8/1991 | Vaughn et al. | 405/209 |
| 5,140,924 | A | 8/1992 | Dixon | |
| 5,173,182 | A | 12/1992 | Debellian | |
| 5,232,385 | A | 8/1993 | Hatfield | |
| 5,277,142 | A | 1/1994 | Connor | |
| 5,415,120 | A | 5/1995 | Burg | |
| 5,544,610 | A | 8/1996 | Harding | |
| 5,586,921 | A | 12/1996 | Kobayashi et al. | |
| 5,586,922 | A | 12/1996 | Kobayashi et al. | |
| 5,595,132 | A | 1/1997 | Bystedt et al. | |
| 5,746,146 | A | 5/1998 | Bixel, Jr. | |
| 5,807,029 | A | 9/1998 | Ellnor | |
| 5,823,130 | A | 10/1998 | Kreyn et al. | |
| 5,860,383 | A | 1/1999 | Whitener | |
| 6,044,784 | A | 4/2000 | Gee et al. | |
| 6,050,767 | A | 4/2000 | Gay et al. | |
| 6,178,914 | B1 | 1/2001 | Axelsson | |
| 6,223,669 | B1 | 5/2001 | Bowden | |
| 6,257,165 | B1 | 7/2001 | Danos, Jr. et al. | |
| 6,532,884 | B2 | 3/2003 | Profitt et al. | |
| 6,550,408 | B1 | 4/2003 | Janssen | |
| 6,584,923 | B2 * | 7/2003 | Le Lan et al. | 114/72 |
| 6,619,904 | B1 | 9/2003 | Barry | |
| 6,668,747 | B2 | 12/2003 | Kjerstad | |
| 6,688,248 | B2 * | 2/2004 | Roodenburg | 114/61.12 |
| 6,863,484 | B2 | 3/2005 | Sridhar | |
| 7,121,782 | B2 | 10/2006 | Barry | |
| 7,231,880 | B2 | 6/2007 | Schmidt et al. | |
| 7,341,422 | B1 | 3/2008 | McCown et al. | |
| 7,527,006 | B2 | 5/2009 | Khachaturian | |
| 7,886,676 | B2 | 2/2011 | Khachaturian | |
| 8,061,289 | B2 | 11/2011 | Khachaturian | |
| 2003/0192465 | A1 | 10/2003 | Roodenburg | |
| 2004/0126211 | A1 | 7/2004 | Barry | |
| 2005/0115484 | A1 | 6/2005 | Leitch et al. | |
| 2007/0251440 | A1 | 11/2007 | Lucas | |

FOREIGN PATENT DOCUMENTS

| | | |
|---|---|---|
| KR | 10-2007-0001638 | 1/2007 |
| SU | 1283153 | 1/1987 |
| WO | WO 9533892 A1 * | 12/1995 |

* cited by examiner

OCEAN GOING TRANSPORT VESSEL WITH DOCKING ARRANGEMENTS

FIELD OF THE INVENTION

This invention relates to seagoing vessels for transport of piece goods, and also to a docking arrangement for such a vessel. In particular this invention relates to a vessel for transport of machinery and equipment to and from off-shore installations such as in the oil and gas industry, although it may have application in other endeavours.

BACKGROUND ART

The following discussion of the background art is intended to facilitate an understanding of the present invention only. It should be appreciated that the discussion is not an acknowledgement or admission that any of the material referred to was part of the common general knowledge in Australia or elsewhere as at the priority date of the application.

Various types of ocean going vessel have been described for transport of piece goods for the construction and operation of offshore facilities in the oil and gas industry. This invention seeks to provide an alternative ocean going vessel that is expected to have utility in this technical field, in addition to other fields.

Throughout the specification unless the context requires otherwise, the word "comprise" or variations such as "comprises" or "comprising", will be understood to imply the inclusion of a stated integer or group of integers but not the exclusion of any other integer or group of integers.

Throughout the specification unless the context requires otherwise, the word "include" or variations such as "includes" or "including", will be understood to imply the inclusion of a stated integer or group of integers but not the exclusion of any other integer or group of integers.

DISCLOSURE OF THE INVENTION

In accordance with the invention there is provided an ocean going transport vessel comprising a pair of longitudinal hulls spaced apart substantially parallel to each other, supporting a first deck portion located above said hulls, said first deck portion extending across said hulls and forming a structural link therebetween, said first deck portion being located toward one end of said hulls, and preferably above the normal operating waterline of said vessel; each said hull including a further deck portion extending at least from said first deck portion to the other end of said hulls, said hulls having a plurality of ballast tanks located therealong provided to allow adjustment of the draft and trim of said vessel, said hulls and said deck portions forming a U-shape when viewed from above and below, having a void extending between opposed said further deck portions and associated hulls, said void being provided for stowage or suspension of a load or subassembly in the form of a cradle, a frame, or a deck, wherein said further deck portions extend longitudinally beyond said hulls, supported in cantilever-type fashion as cantilevered deck portions which each include a docking point arranged to support the vessel by the cantilevered deck portions, by said docking point resting on a structural support. The structural support would be a load bearing support on a wharf or dock, capable of supporting the weight of the vessel bearing through the docking points.

Preferably each said docking point is located on the underside of each said cantilevered deck portion.

Preferably said docking point includes hydraulic height adjustment to adjust the load on the docking point and/or positioning of the cantilevered deck portions in response to vessel movement due to water movement or displacement variations caused by loading or unloading or in response to ballast tank adjustments.

Preferably said docking point includes load monitoring at said docking point, feeding back to said hydraulic height adjustment, and also feeding back to control of ballast tank levels.

Preferably said first deck portion is located above the normal operating waterline of said vessel.

Preferably the length of the void is at least two times the length of the first deck portion.

Preferably the length of the void is at least two and a half times the length of the first deck portion.

Preferably the length of the void is at least three times the length of the first deck portion.

Preferably the length of the void is at least three and a half times the length of the first deck portion.

Preferably said hulls each comprise a pontoon, and said first deck portion and said further deck portions are supported off said pontoons by structure extending between said deck portions and said pontoons.

Preferably said structure comprises a plurality of caissons.

Preferably said structure comprises three caissons extending from each said pontoon.

Preferably said first deck portion provides a superstructure forming at least a bridge for said vessel and optionally workspace and accommodation for crew.

Preferably the vessel includes at least one overhead gantry supported on and extending between the further deck portions. The, or each, overhead gantry can support hoists, cranes, and the like for performing lifting and loading/unloading functions, as required. It is preferred that there are two such gantries, which can be used for loading and unloading piece goods (or a vessel) onto the subassembly.

Preferably said first deck portion and said further deck portions are contiguous. In this manner, one or both gantries can be run forward onto the first deck portion, where the vessel is required to transport a load that is too high to fit under a gantry.

Preferably said first deck portion is located toward the bow of said vessel, and said further deck portions are located relatively toward the stern of said vessel.

The void is provided for stowage or suspension of a load to be carried by the vessel. In one preferred arrangement the void can accommodate a subassembly which can be raised and lowered to a required height. The subassembly may be in the form of a deck. In a preferred arrangement the raising and lowering of the subassembly may be achieved by strand jacks supported by said vessel and connect to the subassembly or framework carrying the deck. Preferably said strand jacks are supported from said gantries, with each gantry supporting two strand jacks, one near each end of the gantry, connect to or near opposed longitudinal edges of the subassembly. With two gantries there will be four such strand jacks.

Alternatively raising and lowering of the subassembly can be achieved by a coordinated winch system such as a hydraulic climbing jack, or winches or the like. There may be from four to eight winches along each longitudinal edge of the sub assembly. The use of a number of such winches instead of four strand jacks lowers the required capacity of the winches, with the load being able to be shared between them.

For added utility, the deck may have removable panels which can be stowed in said superstructure. With the panels removed, the sub assembly may comprise a framework with transverse ribs which may be utilised as a shiplifter for transport of a ship or barge.

Preferably the framework is constructed to be able to be dismantled and stowed, leaving the void empty so that the vessel can be used to transport a load which is slung beneath the vessel.

Alternatively, the subassembly comprising the deck may be removable, so it can be replaced by an alternative subassembly in the form of framework forming a ship-lifter, allowing the vessel to be used to transport a launch or other vessel that can be accommodated within said void. In a further configuration, the void may be empty, so that the vessel can be used to transport a load which is slung beneath the vessel.

Preferably said subassembly is carried in or on vertically extending tracks secured to said vessel located in spaced relation along the longitudinal extent of said void.

Preferably said subassembly can be secured at different heights along said vertically extending tracks. In a preferred arrangement, said subassembly includes mechanisms arranged to engage with pins which extend in said vertically extending tracks.

It is most preferred that said pins are located recessed within said vertically extending tracks. In this arrangement, preferably said mechanisms engaging with said pins also are locatable recessed within said vertically extending tracks, restraining said sub assembly against fore and aft movement.

Preferably said vessel includes removeable transverse bracing extending between said hulls. Preferably said vessel includes removeable transverse bracing extending between said pontoons. Preferably said removeable transverse bracing is securable in said vertically extending tracks. Preferably said removeable transverse bracing is securable in proximity to said caissons.

Preferably said removeable transverse bracing comprises diagonal braces extending centrally from an upper transverse beam, and securable in proximity to said caissons.

Preferably said vessel is provided with deck extensions which may be deployed to extend the further deck portions longitudinally beyond the longitudinal extent of said further deck portions (away from said first deck portion). The deck extensions may be removable for stowage, or may be hingedly attached near or at the extremity of said further deck portions. The deck extensions are capable of supporting an overhead gantry, to assist with loading the vessel from a wharf.

Also in accordance with the invention there is provided a loading system for a vessel as hereinbefore described, said loading system comprising providing in a wharf or at an open end of a dry dock, a structural support arranged in spaced configuration to support said cantilevered deck portions from underneath, said cantilevered deck portions being able to receive one or both of said gantries for loading and unloading said vessel. It should be noted that said cantilevered deck portions need not be able to support the weight of one or both of said gantries without said structural support provided by said wharf or dry to support said cantilevered deck portions from underneath, but the ability of said cantilevered deck portions to support the weight of one or both of said gantries would be desirable in a preferred form of the invention.

Preferably said structural support arranged in spaced configuration to support said cantilevered deck portions from underneath contacts said docking point.

Preferably in said loading system, said wharf or dry dock includes parallel tracks in alignment with said cantilevered deck portions to receive one or both of said gantries for loading and unloading said vessel.

BRIEF DESCRIPTION OF THE DRAWINGS

A preferred embodiment of the invention will now be described in the following description of a heavy-lift semi-submersible catamaran and docking and loading system, made with reference to the drawings in which.

BEST MODE(S) FOR CARRYING OUT THE INVENTION

Figure 1:
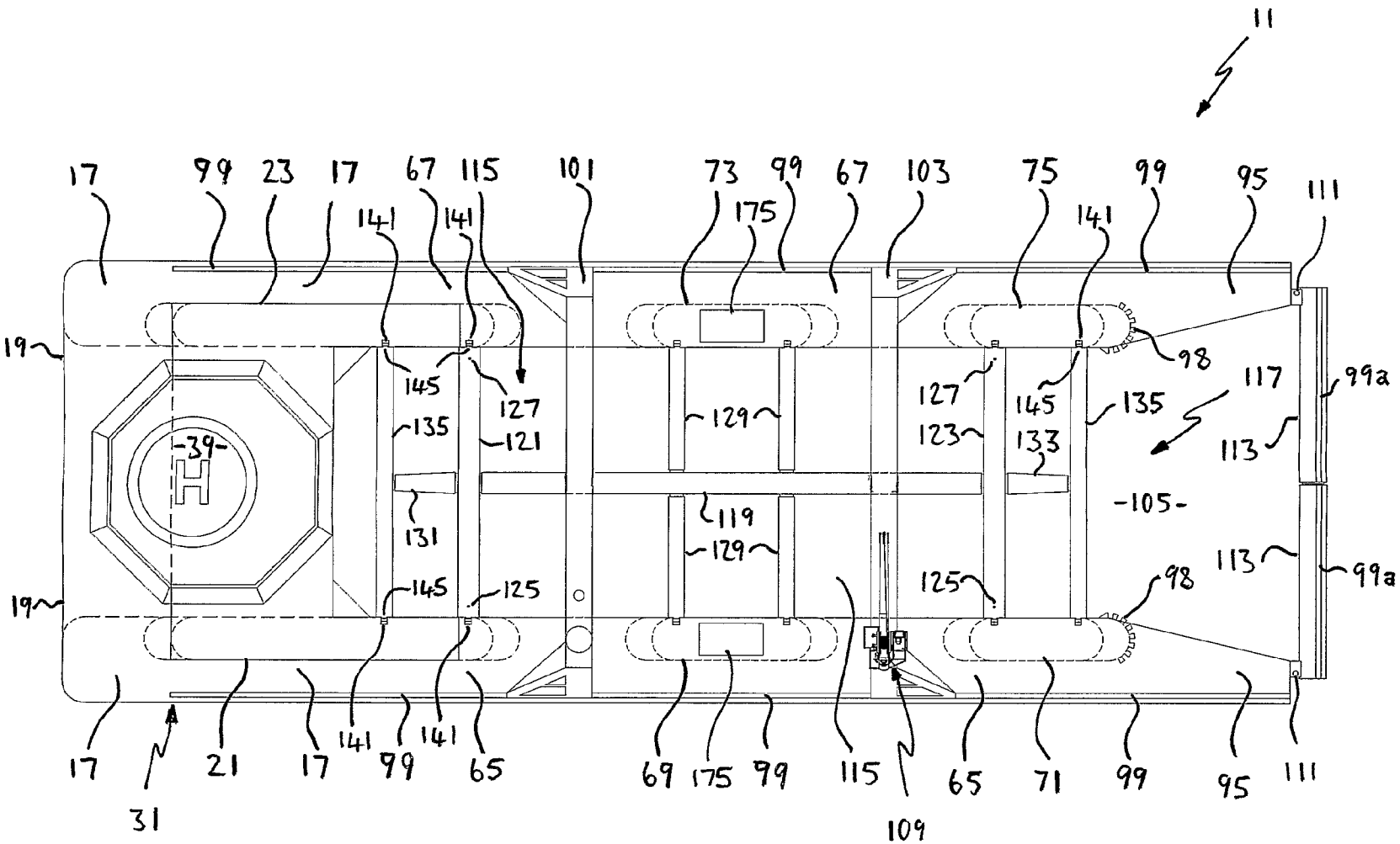
FIG. 1 is a plan view from above of the catamaran according to the embodiment.
Figure 2:
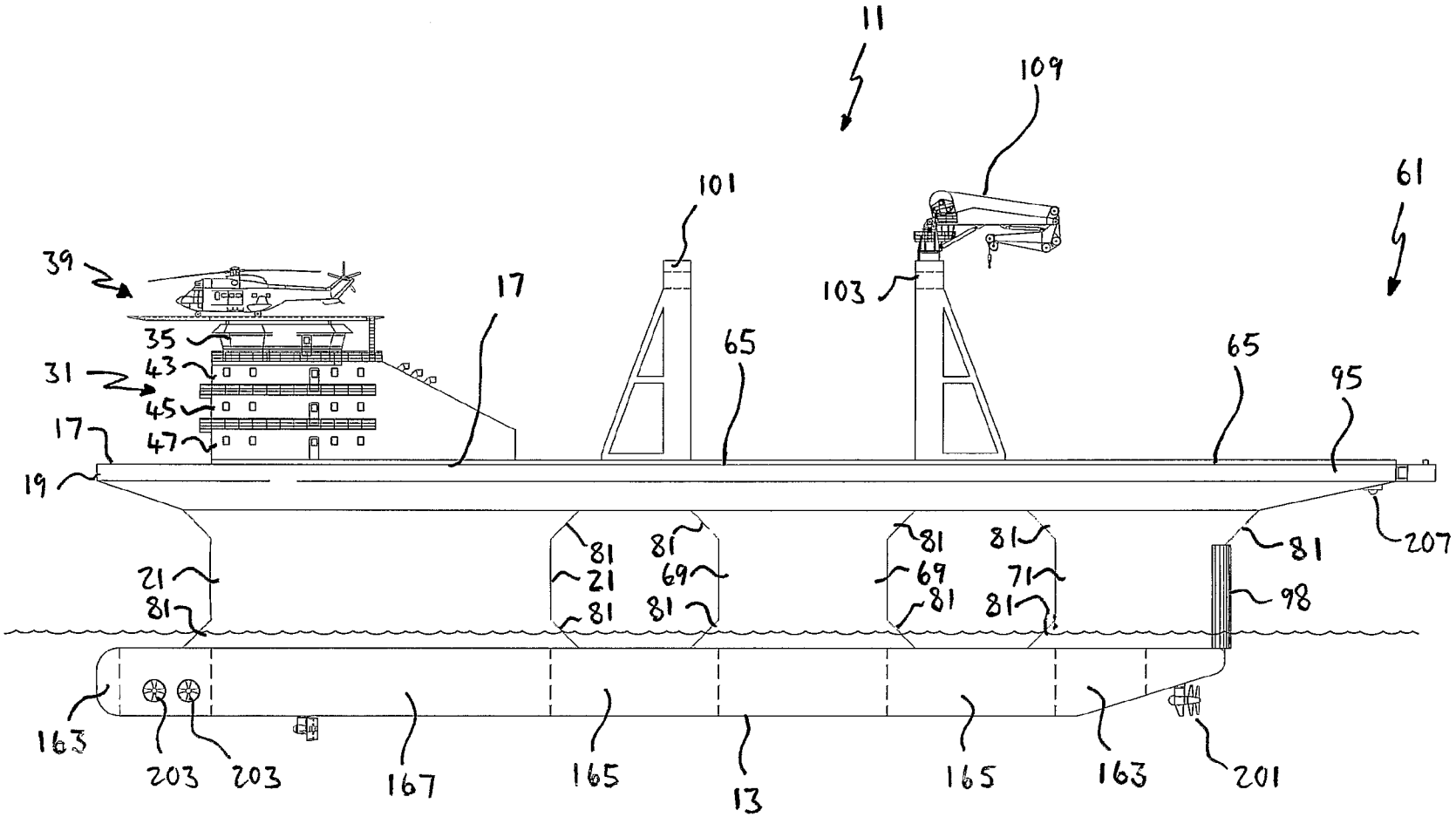
FIG. 2 is a port side view of the catamaran of FIG. 1.
Figure 2A:
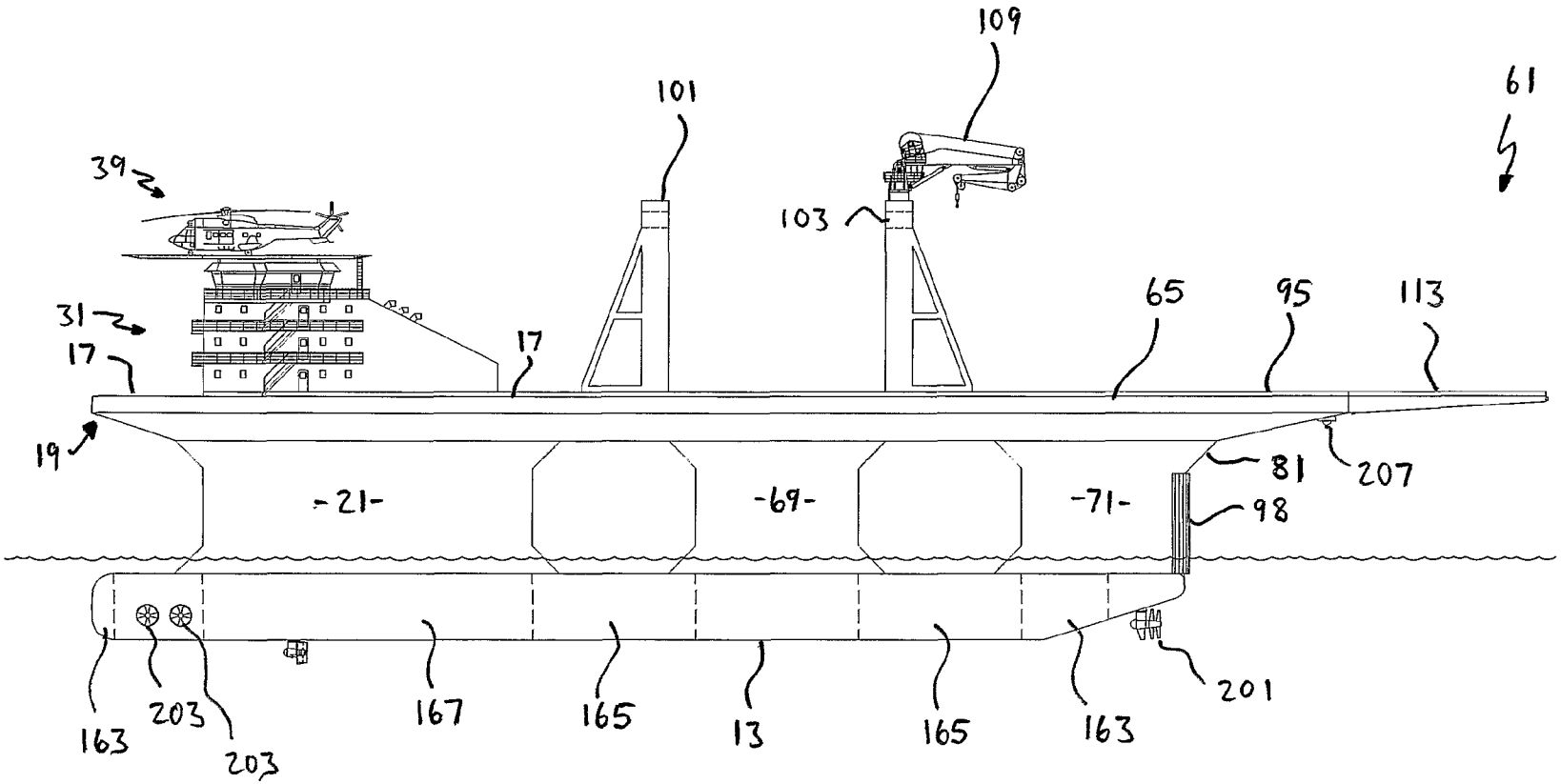
FIG. 2*a* is another port side view of the catamaran of FIG. 1 shown deck extensions deployed.
Figure 3:
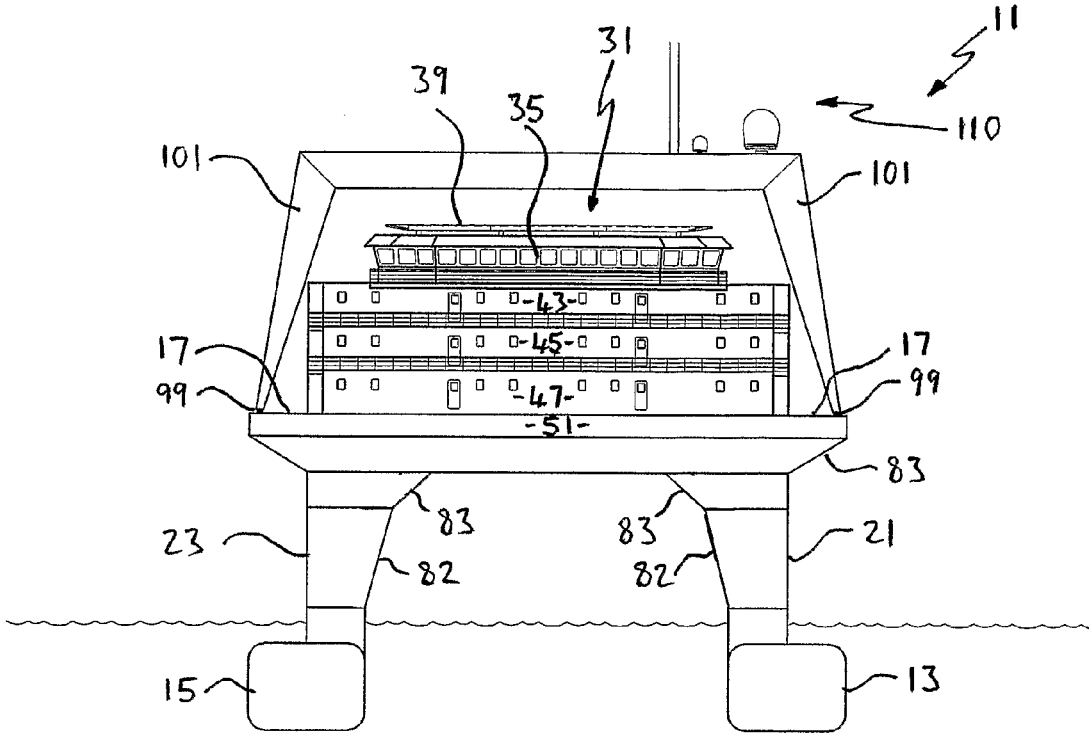
FIG. 3 is a front plan view of the bow of the catamaran of FIG. 1.

The preferred embodiment is an ocean-going transport vessel in the form of a catamaran 11, illustrated generally in FIGS. 1 to 5. The catamaran 11 has a pair of longitudinal hulls in the form of a port side pontoon 13 and a starboard side pontoon 15, which are spaced apart from each other, parallel to each other. The pontoons 13 and 15 support a first deck portion in the form of a foredeck 17 located above the pontoons 13, 15, toward the bow 19 of the catamaran 11. The foredeck 17 is mounted to the pontoons 13, 15 on structure in the form of caissons 21, 23 extending from each pontoon 13, 15, up to the foredeck 17. A superstructure 31 extends above the foredeck 17, and incorporates a bridge 35 with a helideck 39 atop, and three accommodation levels 43, 45, 47 below. Underneath the foredeck 17 is provided a further deck 51 for machinery storage and other operational purposes.

Behind the foredeck 17, extending toward and to the stern 61 of the catamaran 11 are further deck portions 65, 67 mounted to the pontoons 13, 15 on caissons 69, 71 and 73, 75 respectively.

The foredeck 17, superstructure 25, further deck portions 65, 67, the caissons 21, 23, 69, 71, 73, 75, and pontoons 13, 15 form a structurally rigid unit capable of withstanding torsion and flexing brought about by forces imposed on the pontoons 13, 15 due to ocean swells. Angled plate portions 81 at the tops and bottoms of the caissons provide improved fore/aft relative torsional rigidity between the pontoons and decks, and referring to FIG. 3, further angled plate portions 82 on the inside of the caissons 21 and 23 and still further angled plate portions 83 at the tops of the caissons 21 and 23 on both the inside and outside thereof to provide improved lateral relative torsional rigidity between the pontoons and decks.

The further deck portions 65, 67 extend aft of the rearward ends 91 of the pontoons 13, 15 as cantilevered deck portions 95, 97, supported by angle plate portions 81 providing a cantilever support from the rearward caissons 71 and 75. Fendering 98 is provided at the rear (most aft) part of the rearward caissons 71 and 75.

The foredeck 17, further deck portions 65, 67, and cantilevered deck portions 95, 97 are contiguous to provide a surface that vehicles may traverse. Each further deck portion 65, 67 includes a longitudinal track 99, the longitudinal tracks being aligned in parallel, and extending across the foredeck substantially to the bow 19, and extending across the cantilevered deck portions 95, 97 to the edge of cantilevered deck portions 95, 97. The tracks 99 receive two overhead gantries 101, 103, which can be moved along the tracks 71, and parked over the superstructure 31. Each gantry supports a pair of nominal 500 tonne strand jacks 105, 107, and the rearward gantry also includes a 35 tonne hydraulic knuckle boom crane 109. The forward gantry also includes services 110 in the form of antennae and radar equipment. It will be appreciated that other hoists and cranes may be fitted to the gantries as required.

At the stern of the catamaran 11 and at the most aft of the cantilevered deck portions 95 and 97 are located on vertical pivots 111 to each cantilevered deck portion 95 and 97, is a deck extension 113, which also each have a track 99*a* which continues track 99 when the deck extensions 113 are extended. The deck extensions 113 are shown stowed in FIGS. 1, 2 and 7, and extended in FIGS. 2*a* and FIGS. 5, 6 and 8.

The deck extensions 113 are removeable, and may be stowed when not required, for example when the catamaran is to be used in certain docking and deployment procedures. While the deck extensions 113 are shown with pivoting attachment to the cantilevered deck portion 95 and 97, it will be appreciated that in alternative embodiments, alternative arrangements my be adopted such as horizontal pivoting, telescoping, or even pick and place deployment.

Viewed from above, the foredeck 17, further deck portions 65, 67, and cantilevered deck portions 95, 97 form a U-shape with a void 115 extending vertically and longitudinally rearwardly between opposed further deck portions 65, 67 and cantilevered deck portions 95, 97 (and also the pontoons 13, 15), which is open at the stern 61 of the catamaran 11. Located within the void 115 is a deck in the form of a ship lifting cradle 117.

Figure 22:
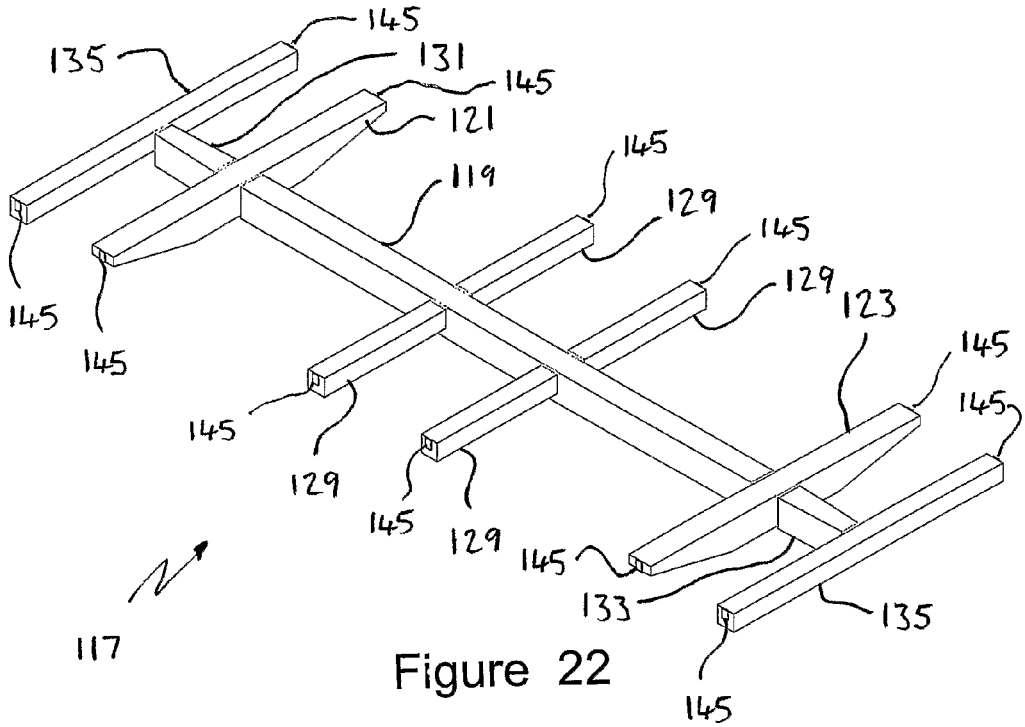
FIG. 22 is a perspective view of one configuration of a sub assembly in the form of a ship lifting cradle.
Figure 23:
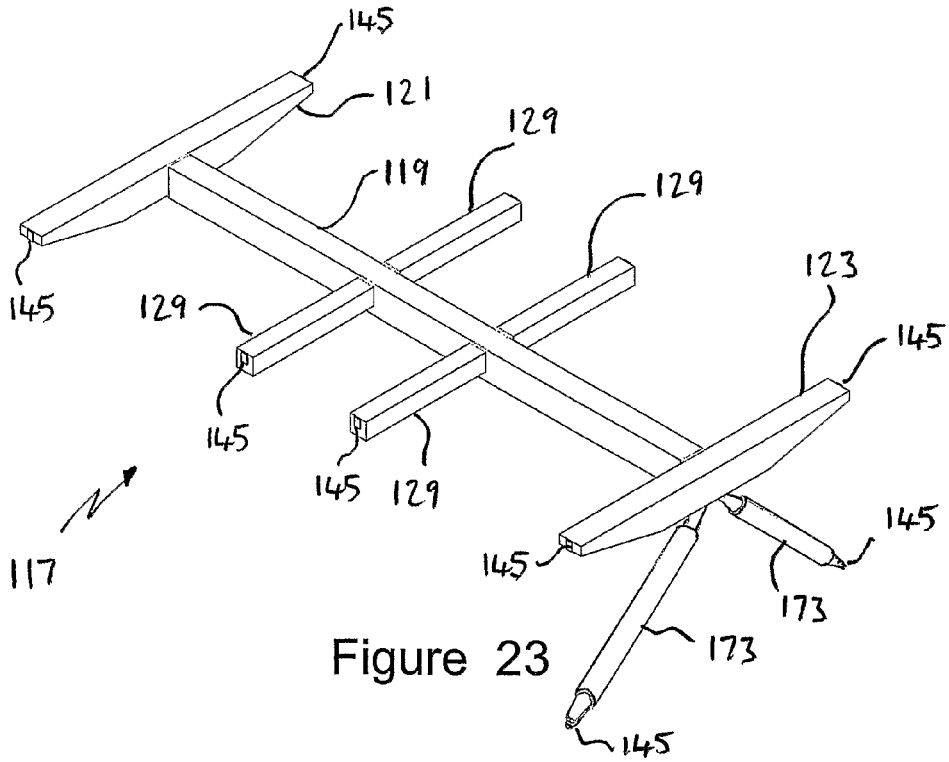
FIG. 23 is a perspective view of another configuration of a sub assembly in the form of a ship lifting cradle.

Referring to FIGS. 22 and 23, two alternate versions of a sub assembly in the form of a ship lifting cradle 117 are shown. FIG. 22 shows a full length version of a ship lifting cradle 117, while FIG. 23 shows a shorter version of a ship lifting cradle 117. Both versions of the ship lifting cradle 117 have a central longitudinal beam 119 which extends between a fore transverse beam 121 and an aft transverse beam 123. The transverse beams 121 and 123 each have a cable 125 and 127 of the strand jacks 105 and 107 attached to them, so that the sub assembly can be raised and lowered. Located between the transverse beams 121 and 123 are four intermediate transverse members 129 arranged as two pairs extending either side of the central longitudinal beam 119. The full length ship lifting cradle 117 of FIG. 22 differs by the addition of a fore longitudinal extension 131 and an aft longitudinal extension 133 which effectively extend the length of the central longitudinal beam 119. At the extreme ends of these longitudinal extensions 131 and 133 is located a further transverse member 135.

Figure 6:
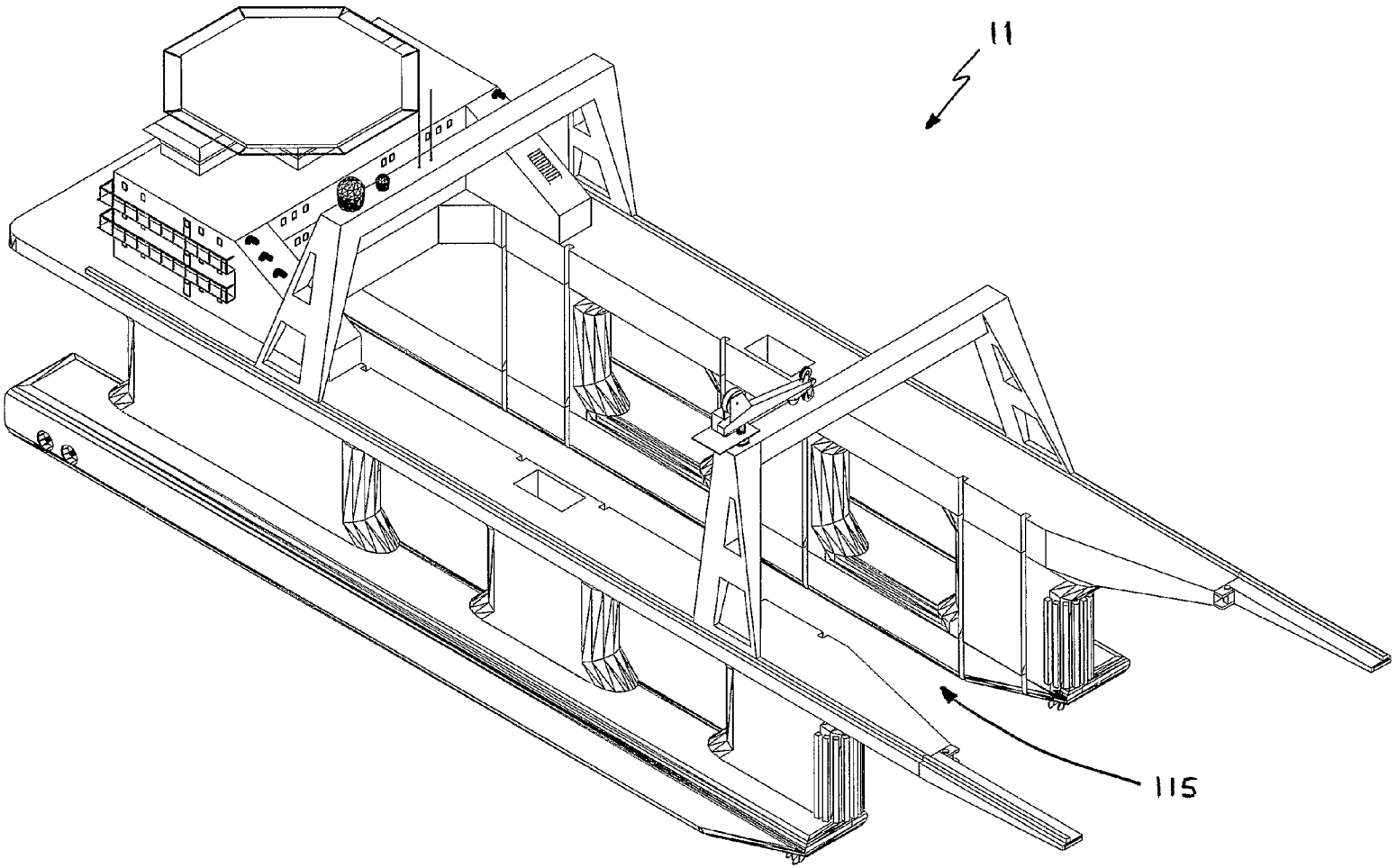
FIG. 6 is a perspective view of the catamaran of FIG. 1 with deck extensions deployed and showing the catamaran with no sub assembly fitted.
Figure 7:
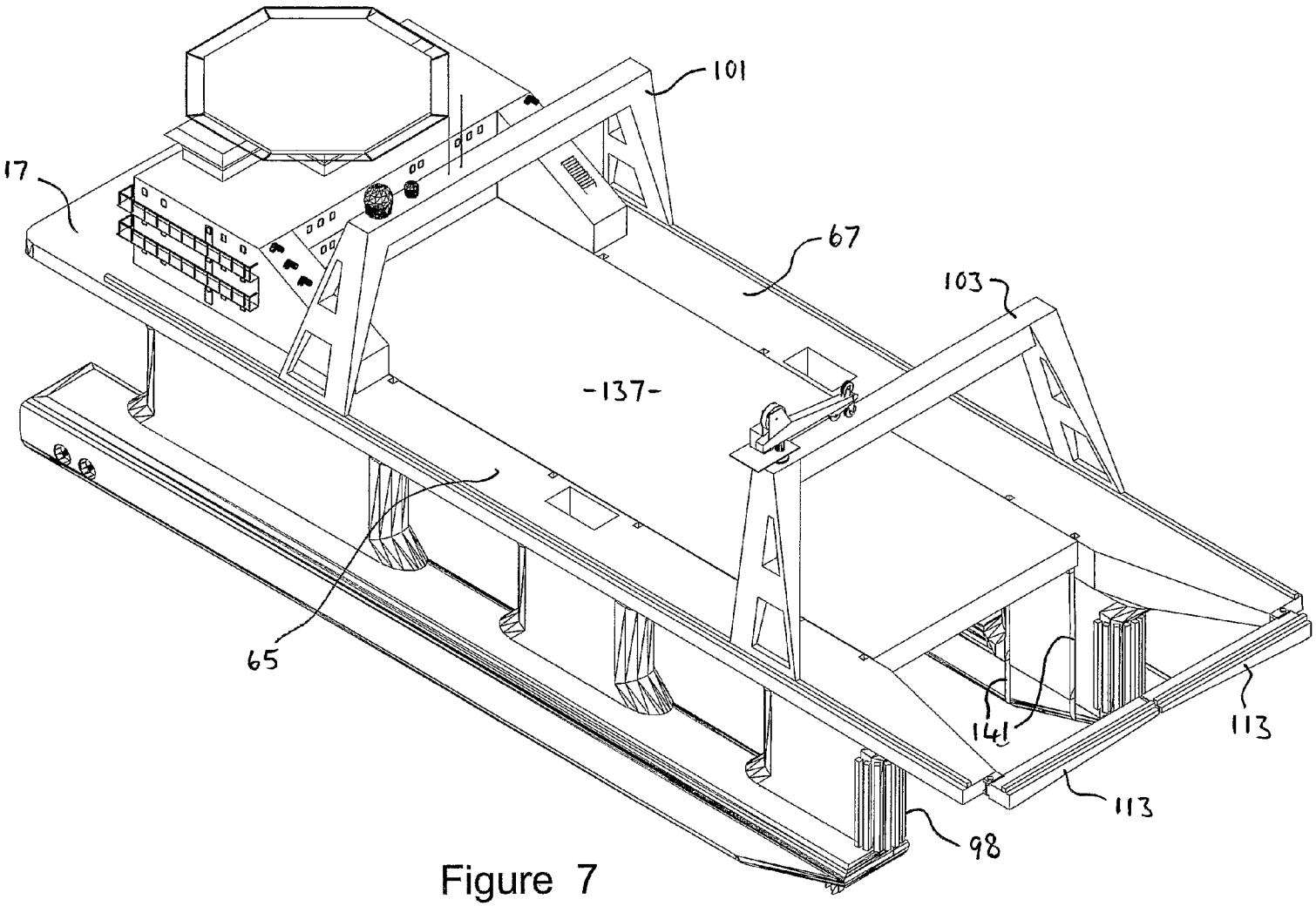
FIG. 7 is a perspective view of the catamaran of FIG. 1 with deck extensions stowed and showing a sub assembly in the form of a flat deck in a raised position.
Figure 8:
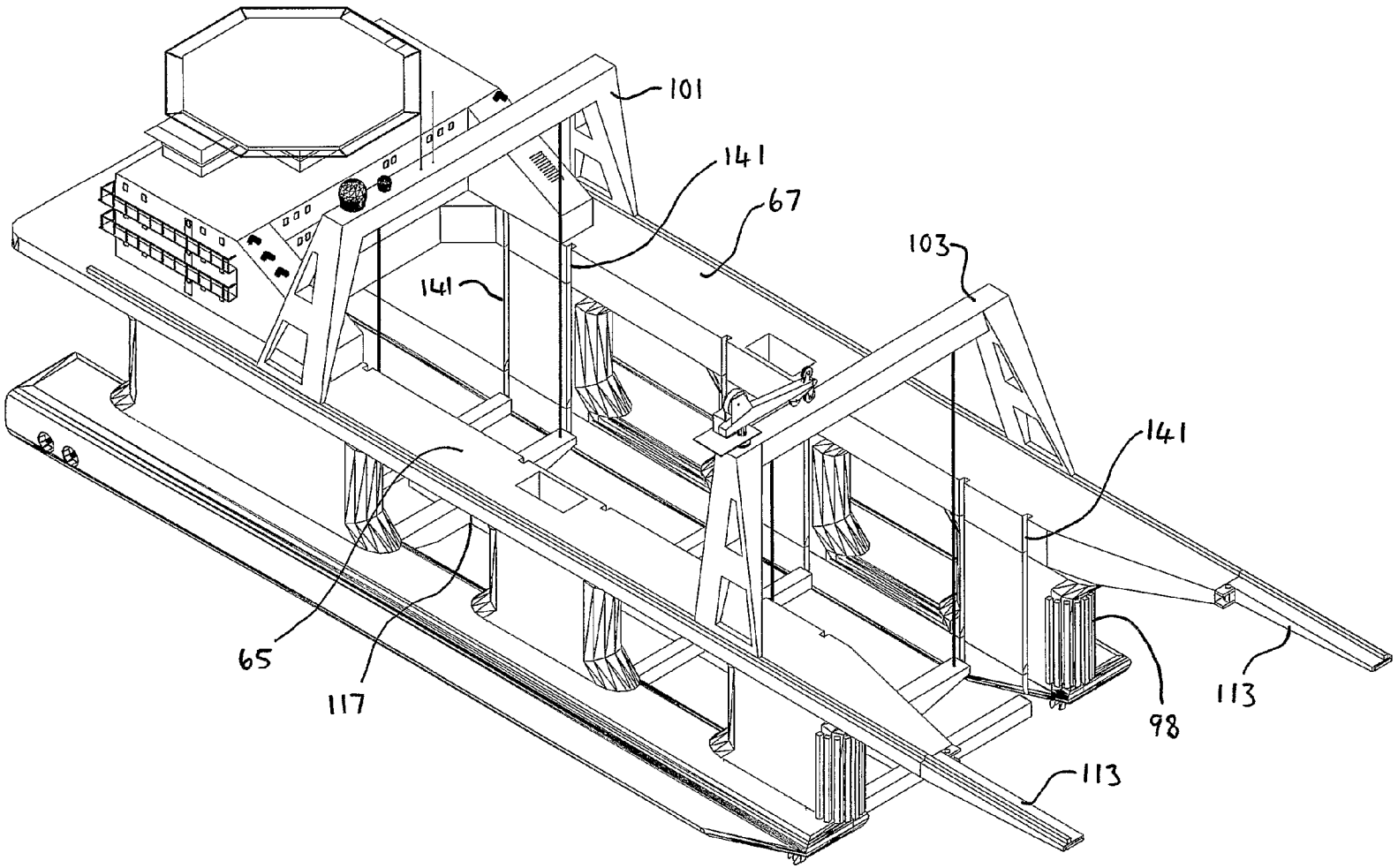
FIG. 8 is a perspective view of the catamaran of FIG. 1 with deck extensions deployed and showing a sub assembly in the form of a ship lifting cradle in a lowered position.

The ship lifting cradle of FIG. 22 can be stripped down by removal of the further transverse members 135 and longitudinal extensions 131 and 133, which can be stowed aboard the catamaran at the rear of the superstructure, to reconfigure the ship lifting cradle 117 version shown in FIG. 23. The ship lifting cradle 117 can be further stripped down by removal of the intermediate transverse members 129 and the central longitudinal beam 119, the latter of which may be stored slung under one of the further deck portions 65 or 65. Either of the further transverse members 135, and transverse beams 121 and 123 may be removed and stored or left in place, in accordance with operational requirements. FIG. 6 shows the catamaran with the ship lifting cradle completely stripped down and stowed. FIG. 8 shows the catamaran with the FIG. 7 shows the catamaran with the sub assembly of the ship lifting cradle 117 raised to an uppermost position, and fitted with flat panels to form a deck 137 which is contiguous with the deck further deck portions 65 and 67. FIG. 8 shows the catamaran with the ship lifting cradle 117 fully assembled, and locked off in a lowermost position.

The securing to the catamaran of the further transverse members 135, the transverse beams 121 and 123, and the intermediate transverse members 129 will now be described.

Extending vertically below the further deck portions 65, 67 are vertically extending tracks in the form of U-channel section members 141 which provide a vertically extending track to locate the further transverse members 135, the transverse beams 121 and 123, and the intermediate transverse members 129 of the ship lifting cradle 107. Referring to FIGS. 24 to 27, running within the vertically extending track of each U-channel section member 141 is a row of pins 143 of nominal 200 mm diameter (anywhere from 200 mm to 350 mm diameter should be sufficient—it should be understood that the pin diameter is determined by the load to be supported), the spacing of which determine incremental lock off heights for the ship lifting cradle 117. The pins 143 extend in a longitudinal direction, across the space within the U-channel section members 141. The ship lifting cradle 117 can be locked off at different heights by being secured to rest on the pins 143. Each of the further transverse members 135, the transverse beams 121 and 123, and the intermediate transverse members 129 have a mechanism 145 at the outer ends thereof. Each mechanism 145 is arranged to be selectively extended into the space within a U-channel section member 141, to locate the further transverse members 135, the transverse beams 121 and 123, and the intermediate transverse members 129 in respective U-channel section members 141, locating the sub assembly against longitudinal movement relative to the catamaran.

With reference to FIGS. 24 to 27, the mechanism 145 of the transverse beams 121 and 123 is shown. The same mechanism 145 is also employed in the further transverse members 135, the intermediate transverse members 129, and elsewhere as will be explained, although particulars of these applications are not illustrated. The mechanism 145 is largely housed in a recess 146 at the ends 147 of the transverse beams 121 and 123 (and the further transverse members 135, and the intermediate transverse members 129). The mechanism 145 has a hydraulic ram 151 secured to a bulkhead 153 within the beam 121 (and 123) and attached at its moveable end to an upper member 155 having a recess 157 which is sized to accommodate one of the pins 143. The mechanism 145 also has a hydraulic ram 159 attached to the bulkhead 153 underneath the hydraulic ram 151, and attached at its moveable end to a bar 161 which can selectively occlude the recess 157. The bar 161 and upper member are supported on a bearing surface of UHMW polyethylene sheet which lines the recess 146. The recess 157 receives the pin 143 and when locked off by the bar 161, restrains vertical movement of the ship lifting cradle 117 at each pin, relative to the catamaran. The weight of the ship lifting cradle 117 rests the pin 143 in the recess 157.

Figure 24:
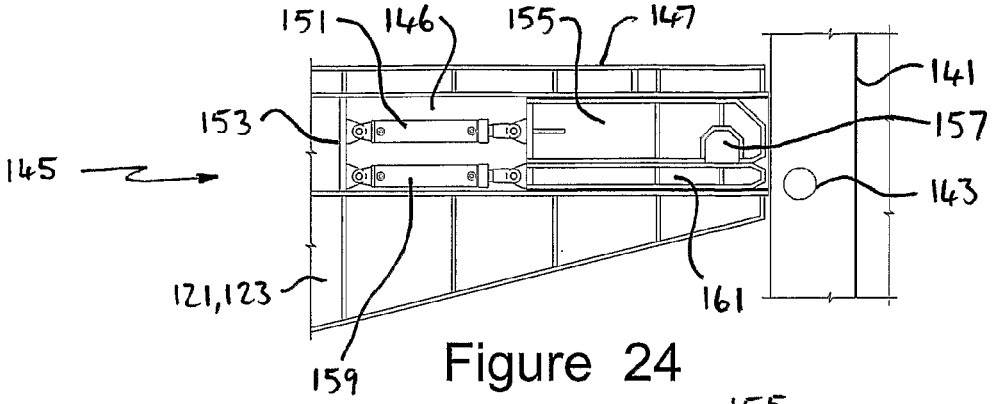
FIGS. 24 to 27 are a sequence of close up side transverse views of a lock-off mechanism for a subassembly incorporated in the catamaran.
Figure 25:
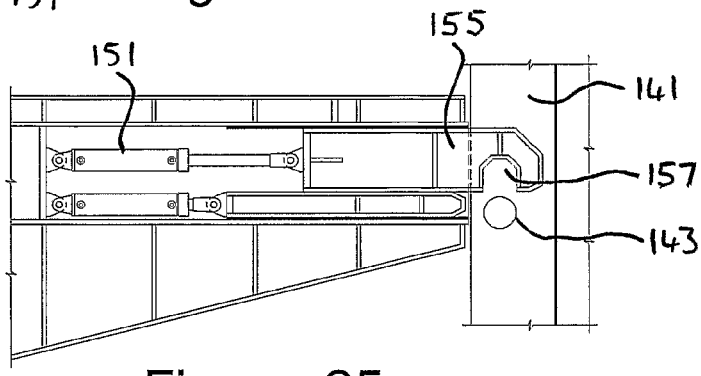
Figure 26:
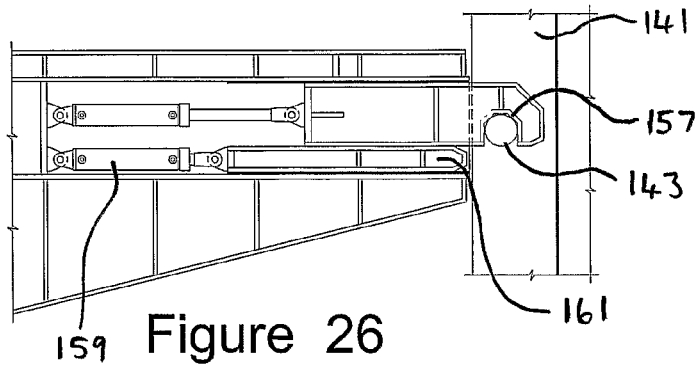
Figure 27:
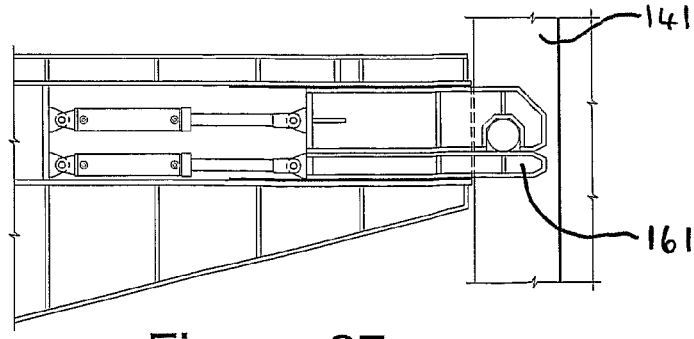

To adjust the height of the ship lifting cradle 117, the hydraulically actuated bar 161 is retracted from the position shown in FIG. 27 to that shown in FIG. 26. Then the ship lifting cradle 117 is raised by the strand jacks 105, 107 to clear the pin 143 from the recess 157 upper member 155, as shown in FIG. 25. The upper member 155 then also retracted as shown in FIG. 24, and the ship lifting cradle 117 can be moved to a different position before the upper member 155 is extended as shown in FIG. 25, and the ship lifting cradle 117 is lowered by the strand jacks 105, 107 to receive a different pin 143 in each recess 157, as shown in FIG. 26, before the hydraulically actuated bar 161 is extended, as shown in FIG. 27, securing the ship lifting cradle 117 in the new position.

While the embodiment is described utilising 4×500 tonne strand jacks, it would also be possible to include an additional four winches connecting to the intermediate transverse members 129 or eight winches connecting to the further transverse members 135 and the intermediate transverse members 129, depending on which ship lifting cradle is deployed. In an alternative arrangement, it would be possible to use twelve winches connecting to the transverse beams 121 and 123, the intermediate transverse members 129 and the further transverse members 135, and dispense with the strand jacks.

In addition, the connection described between the pins 143 and the mechanism 145 is a simple pinned connection. By modifying the mechanism in an alternative embodiment to engage two or more pins simultaneously, the connection between the pins 143 and the mechanism can become a moment connection.

The pontoons 13 and 15 each include a plurality of tanks located therealong provided to allow adjustment of the draft and trim of said vessel. These include (referring to FIGS. 2 and 2*a*) trim ballast tanks 163 located fore and aft, and draft adjusting ballast tanks 165. In addition to these ballast tanks, a fuel tank 167 is provided in each pontoon 13, 15.

Figure 4:
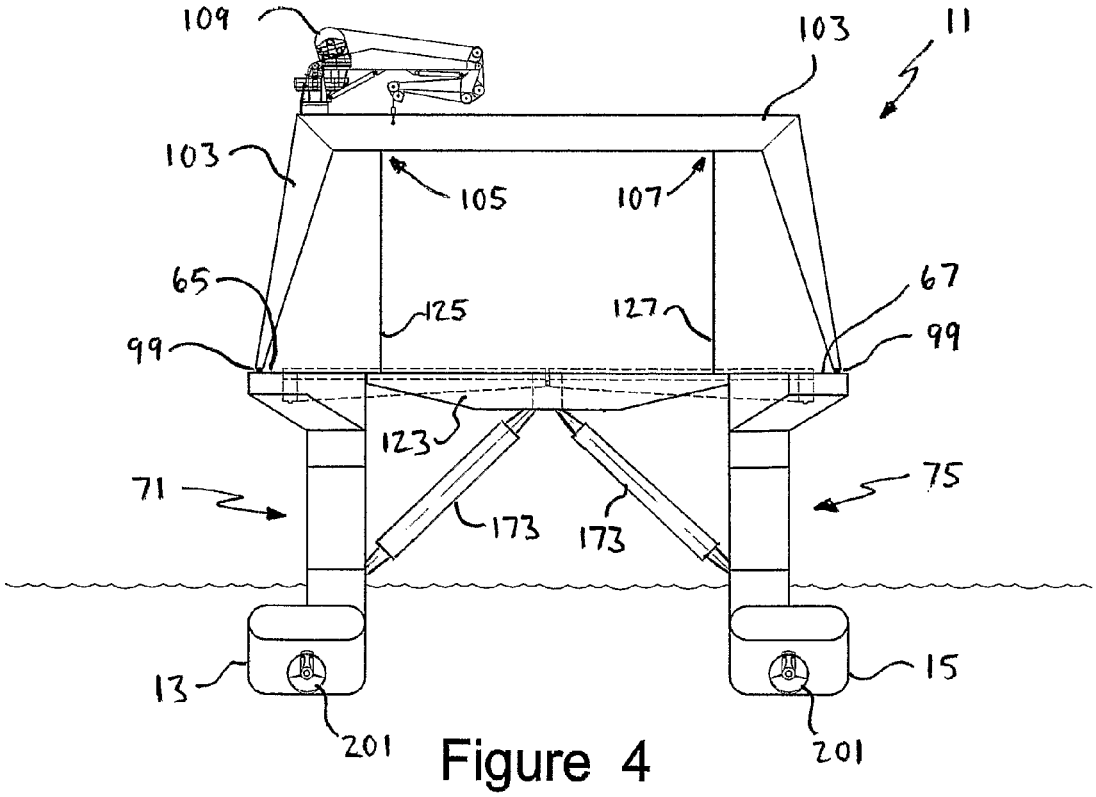
FIG. 4 is a rear plan view of the stern of the catamaran of FIG. 1.
Figure 5:
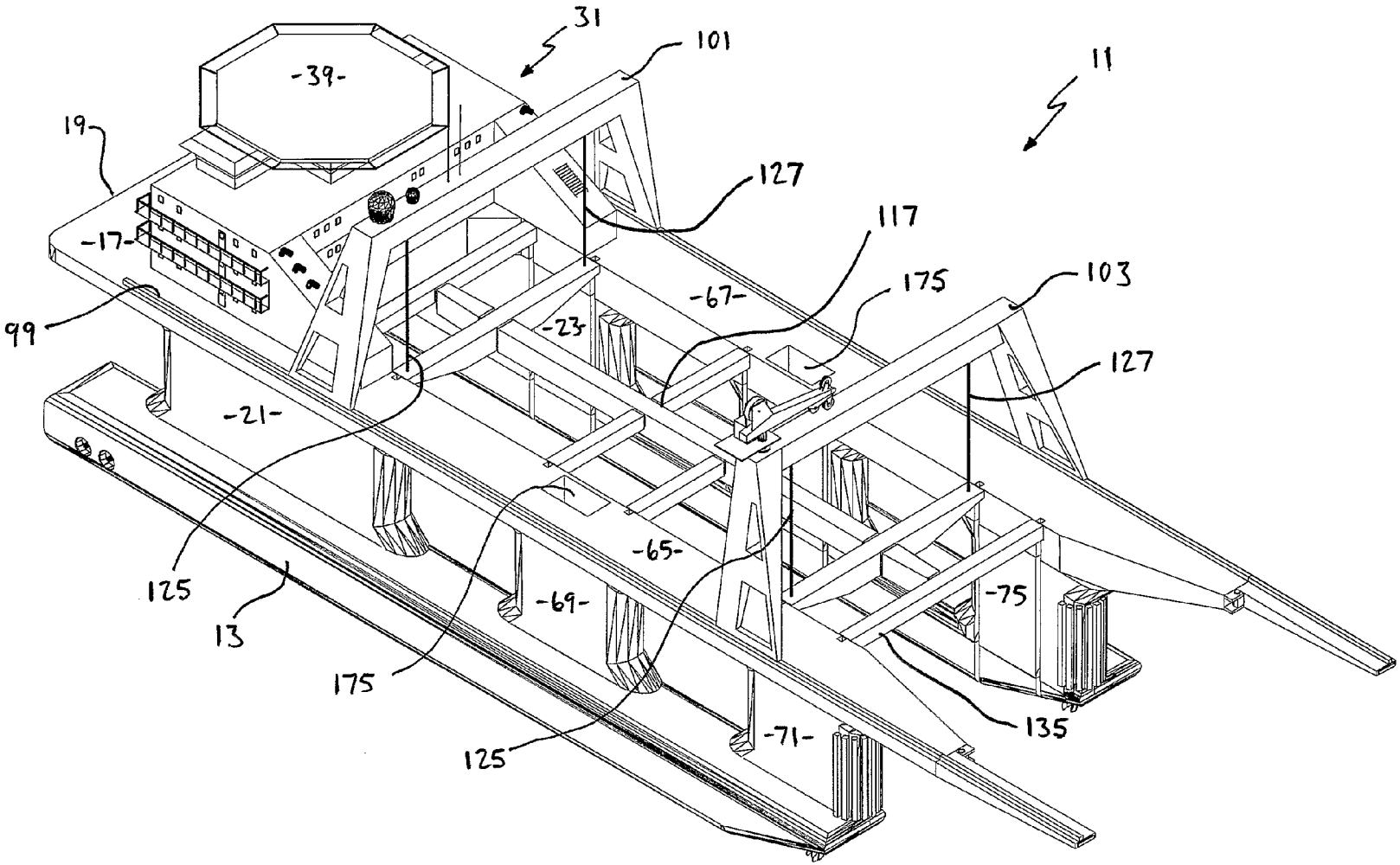
FIG. 5 is a perspective view of the catamaran of FIG. 1 with deck extensions deployed and showing a sub assembly in the form of a ship lifting cradle in a raised position.
Figure 28:
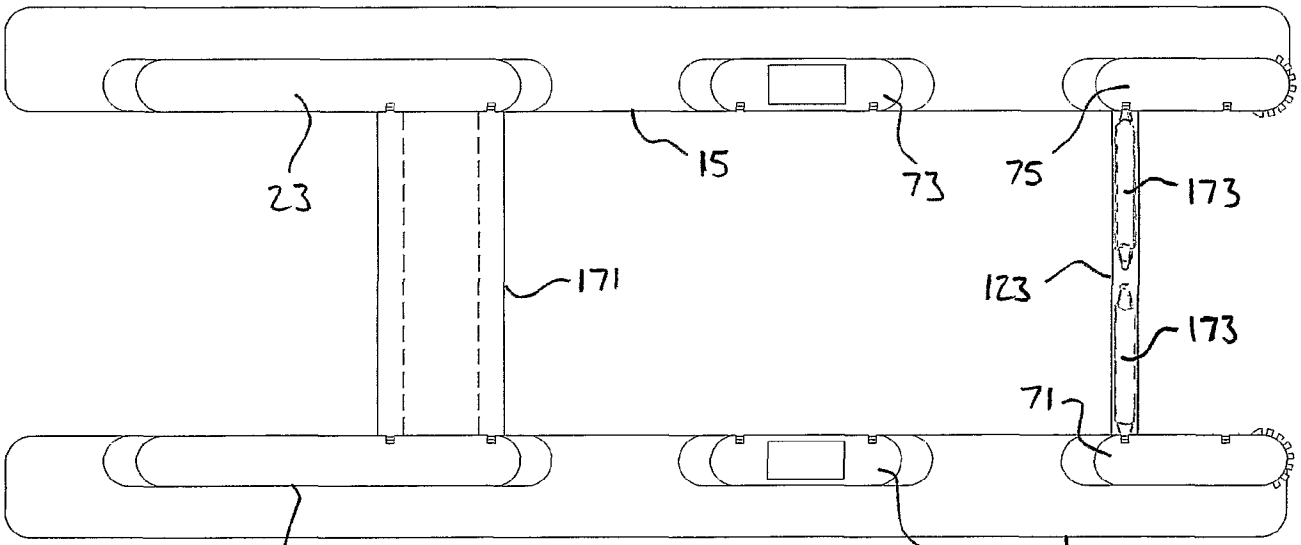
FIG. 28 is a cut-away plan view of the catamaran looking down on the caissons and hulls, showing transverse bracing members fitted extending between the hulls to provide structural rigidity in high seas.
Figure 29:
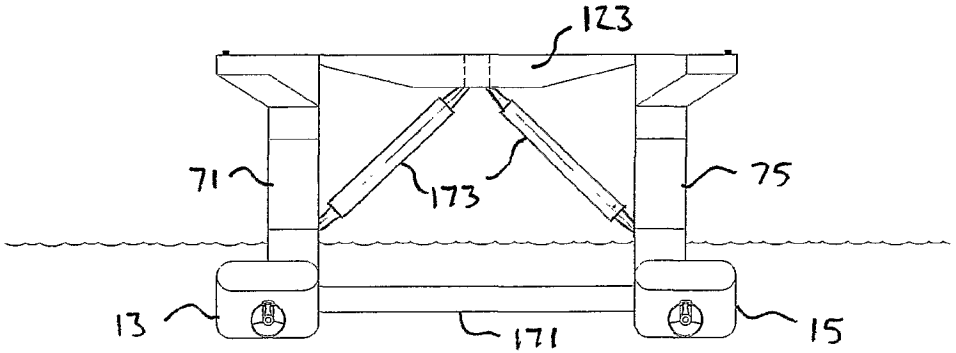
FIG. 29 is a rear plan view of the catamaran shown in FIG. 28.

In normal usage, the space between the pontoons 13 and 15 is free of any obstruction allowing access for the catamaran to straddle any structure in the ocean, subject to adequate clearance for the superstructure 31. However, in high seas, additional structural support can be provided as shown in FIGS. 28 and 29 by removeable transverse bracing in the form of a fore transverse brace 171 extending between pontoons 13 and 15, proximal to caissons 21 and 23, and aft transverse bracing in the form of removeable diagonal braces 173 forming a K-brace, and connecting centrally to the aft transverse beam 123 (of the ship lifting cradle 117. The diagonal braces are provided extending between caissons 71 and 75. This is also shown in FIGS. 4 and 23. It should be noted that the ship lifting cradle is fully dismantleable, and the K-brace may be constituted by the aft transverse beam 123 and diagonal braces 173, without the remainder of the parts that form the ship lifting cradle. The K-brace provides rigidity against torsional forces incident at the foredeck 17 through caissons 21 and 23, due to uneven forces incident along pontoons 13 and 15, which would be expected in severe sea states. The K-brace can be installed prior to an ocean voyage when severe conditions might be expected. For bracing, a single K brace alone should be sufficient, but if deemed necessary a further K-brace could be employed between caissons 69 and 73, and/or the forward transverse brace 171 could also be employed.

The transverse brace 171 and diagonal braces 173 each include at each end, two mechanisms 145 the same as those utilised in the ship lifting cradle, which engage pins 143 in two adjacent tracks 141, proximal to the forward caissons 21 and 23 and proximal to the aft caissons 71 and 75. The transverse brace 171 has a half round profile at the leading and trailing edges to provide some streamlining.

The central caissons 69 and 73 each include a moon pool being an aperture 175 extending from the surface of the deck portions 65 and 67, down to and through the pontoons 13 and 15, through which a remotely operated underwater vehicle may be deployed Covers (not shown) are provided to cover the opening to the aperture 175, when the moon pools are not in use.

At the stern of each pontoon 13, 15 is located a pair of thrusters 201 having adjustable azimuth, for propulsion and manoeuvring of the catamaran. At the bow of each pontoon are located two bow thrusters 203, which are located in tubes extending through the pontoons 13, 15, for manoeuvring of the catamaran. In addition, located just behind the bow thrusters on each pontoon 13, 15 is a further thruster 205 which is retractable and adjustable in elevation and azimuth, to assist in manoeuvring of the catamaran. The thrusters are electric, with diesel engines being used to generate required electricity.

Located underneath the cantilevered deck portions 95 and 97 are a docking point 207 which is arranged to be received in a support member 209 which takes the load of the catamaran 11. The docking points 207 and support members should have complimentary configurations to assist in positively retaining the two elements in connection. The docking points 207 each include hydraulic height adjustment with load monitoring feeding back to control circuitry to control the hydraulic height adjustment in order to provide height adjustment for heave compensation and variation in draft brought about by loading and unloading operations. The hydraulic height adjustment at each docking point may be ±1 meter.

The control circuitry is also arranged to control flooding and pumping from the ballast tanks in order to adjust the draft and trim of the catamaran during loading and unloading operations. An advantage of utilising docking support at the cantilevered portions rather than directly at the stern of the catamaran is that application of the load a nominal 15 meters back from the face of the bulkhead formed by the rear of the aft caisson 71 75 reduces the surcharge at the bulk head. In addition the cantilever support and load transfer system enables mobilisation of the full ballast system along the length of each pontoon, rather than just the adjacent tanks during the initial transfer phases.

Figure 9:
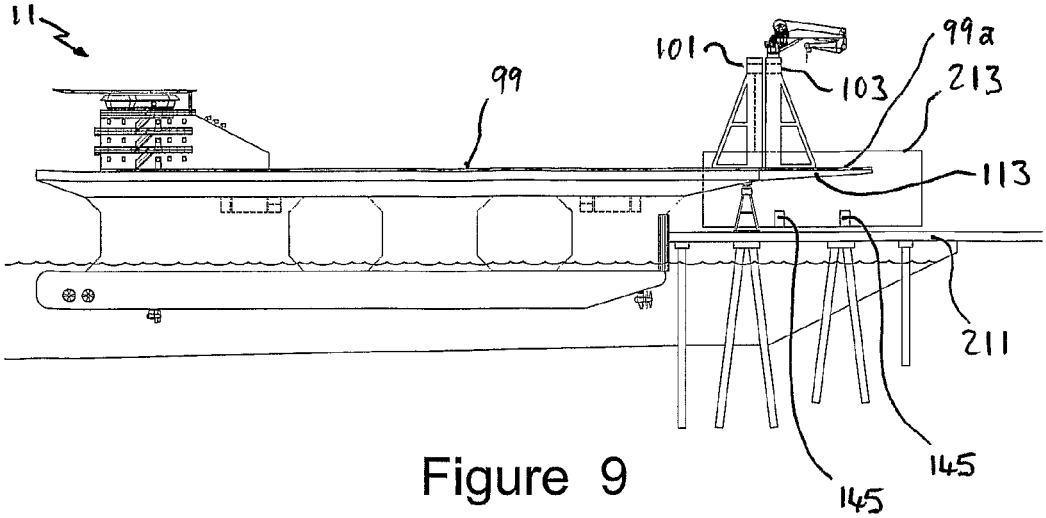
FIGS. 9 to 11 are a sequence of port-side views of the catamaran of FIG. 1, and cross-section view through a wharf illustrating a docking and loading system for the catamaran of the invention, showing a loading sequence.
Figure 10:
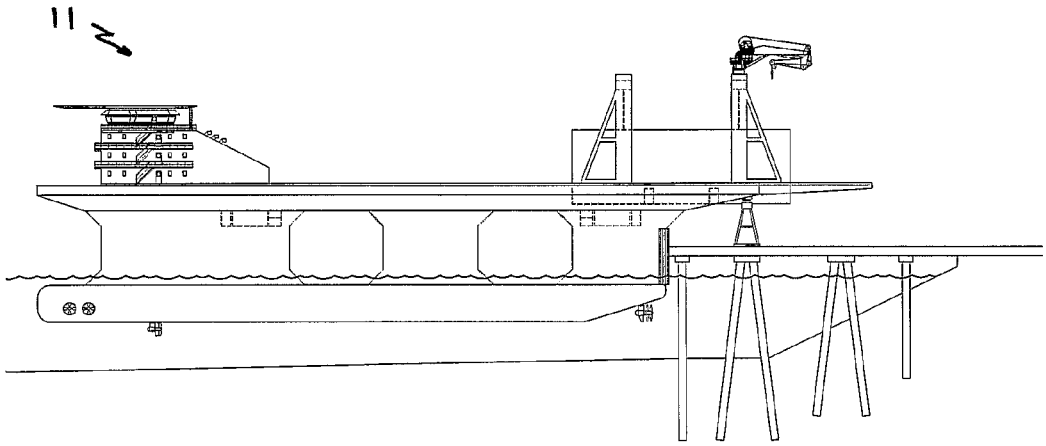
Figure 11:
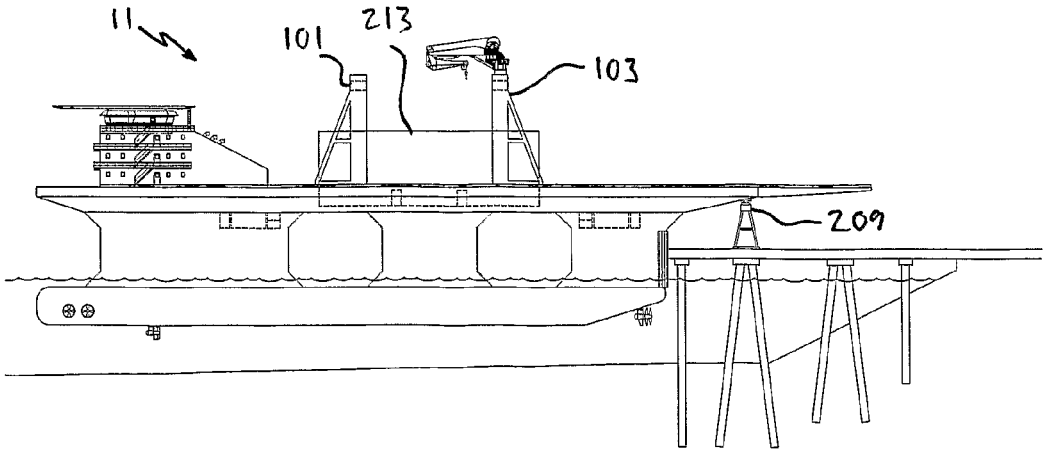

Referring to FIGS. 9 to 11, a sequence of port-side views of the catamaran 11 are shown, with a cross-section view through a wharf 211 illustrating a docking and loading system for the catamaran of the invention, showing a loading sequence of a specialised module 213 for sub-sea deployment. The catamaran 11 is docked to the wharf 211 with docking points 207 engaging with and support members 209. The deck extensions 113 are extended aft and the gantries 101 and 103 are moved along the rail 99 and 99 a onto the deck extensions 113.

Figure 12:
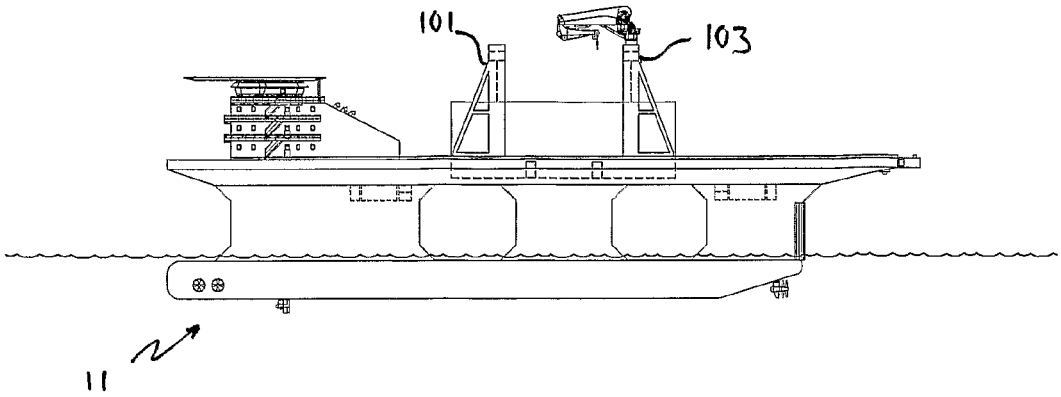
FIGS. 12 and 13 are a sequence of port-side views of the catamaran of FIG. 1, showing a transport and deployment sequence for the load shown in FIGS. 9 to 11.
Figure 13:
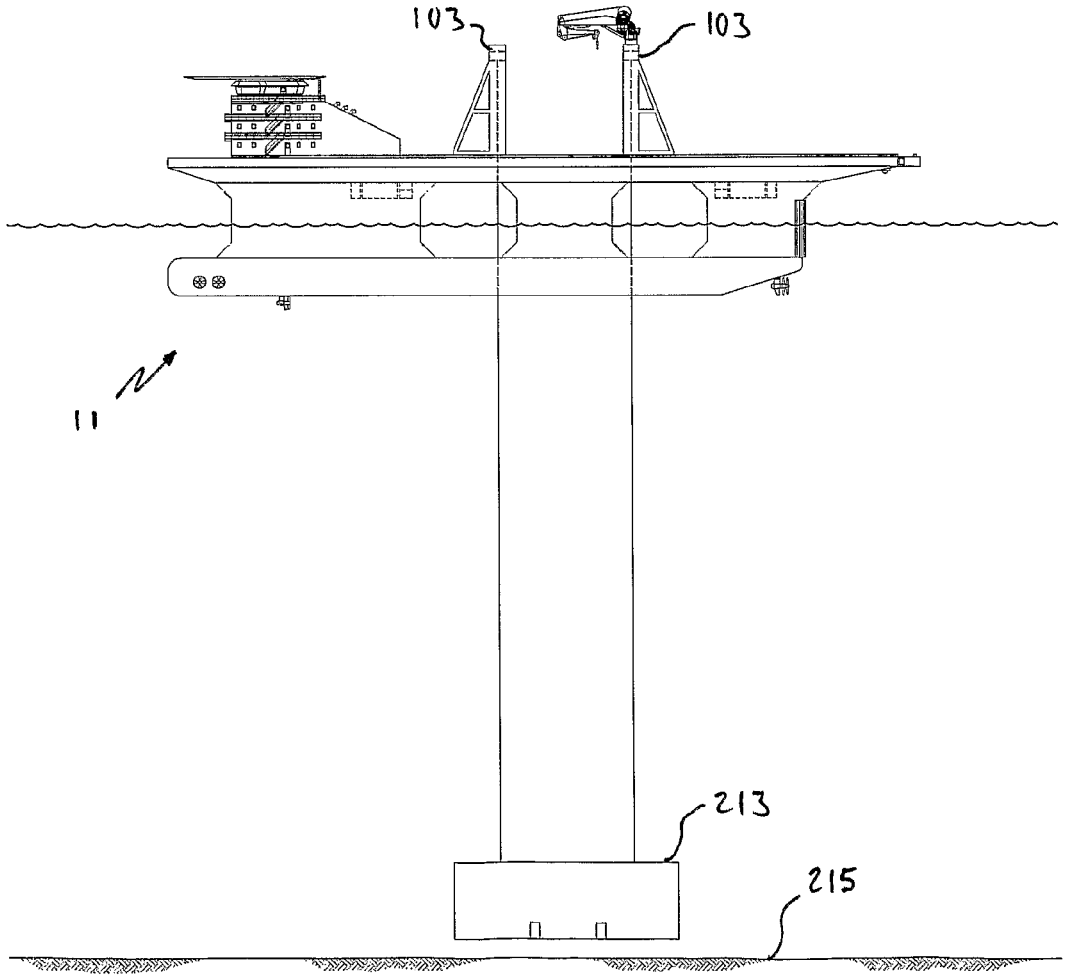

First, the forward gantry 101 has hoists attached to the module 213 and the module is manoeuvred forward to that the rearward gantry 103 can also have its hoists attached to the module 213. The module 213 is raised (see FIG. 10) and transported along the rails 99 until located centrally on the catamaran (see FIG. 11). The module 213 is purpose built and has mechanisms 145 to engage pins 143 in the tracks 141, to secure the module 213 for transport. Referring to FIGS. 12 and 13, with deck extensions 113 retracted, the module 213 is transported to the desired place of deployment, where the mechanisms 145 are disengaged and hoists lower it to the sea floor 215 (see FIG. 13). The ballast tanks can be flooded during this operation to the extent required to increase the draft of the catamaran 11 and improve stability in seas during the lowering operation.

Figure 14:
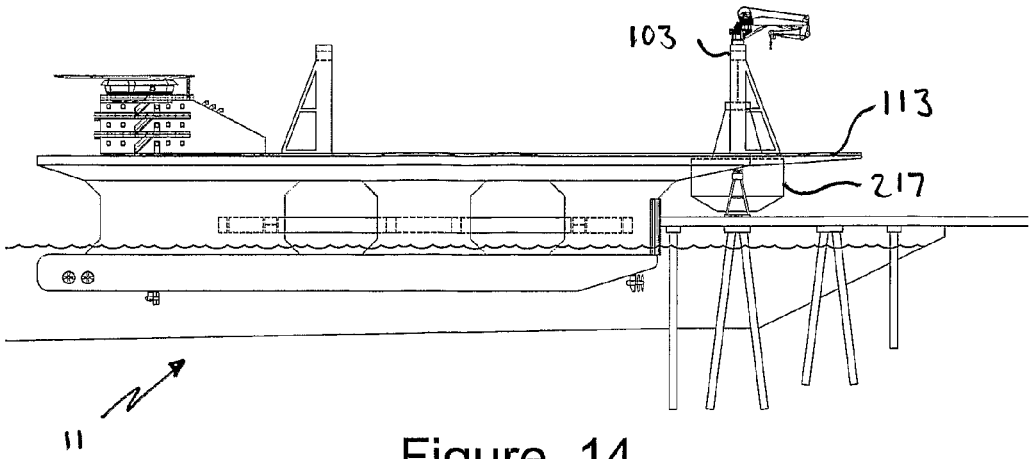
FIGS. 14 to 16 are a sequence of port-side views of the catamaran of FIG. 1, showing a loading and deployment sequence of a navigation buoy.
Figure 15:
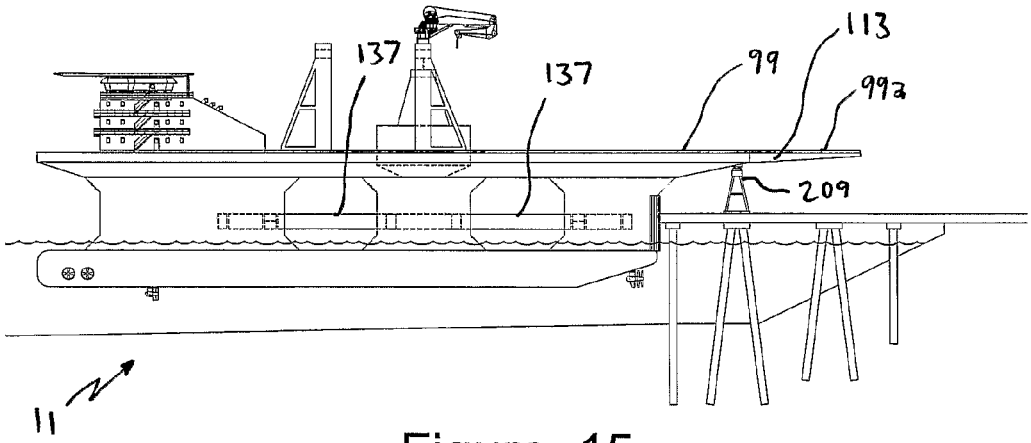
Figure 16:
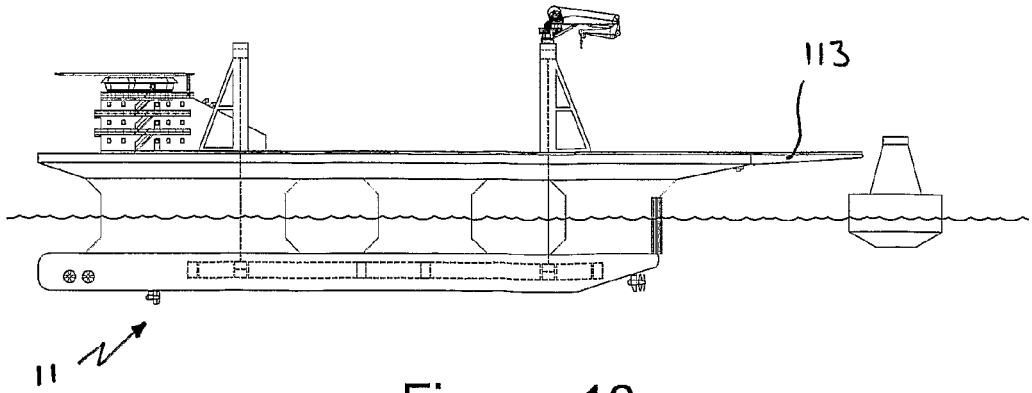

FIGS. 14 to 16 are a similar sequence of port-side views of the catamaran 11, showing a loading in FIGS. 14 and 15, and deployment in FIG. 16, of a mooring buoy 217 which is to be secured by a spread mooring system (not shown). The navigation buoy 217 is loaded by the rearward gantry 103, using hoists. The navigation buoy 217 is placed on the deck 137 of the sub assembly (as shown in FIG. 7), and is transported to the location of deployment. Referring to FIG. 16, the ballast tanks are flooded to float off the navigation buoy, which is tethered to the sea floor in the usual manner.

Figure 17:
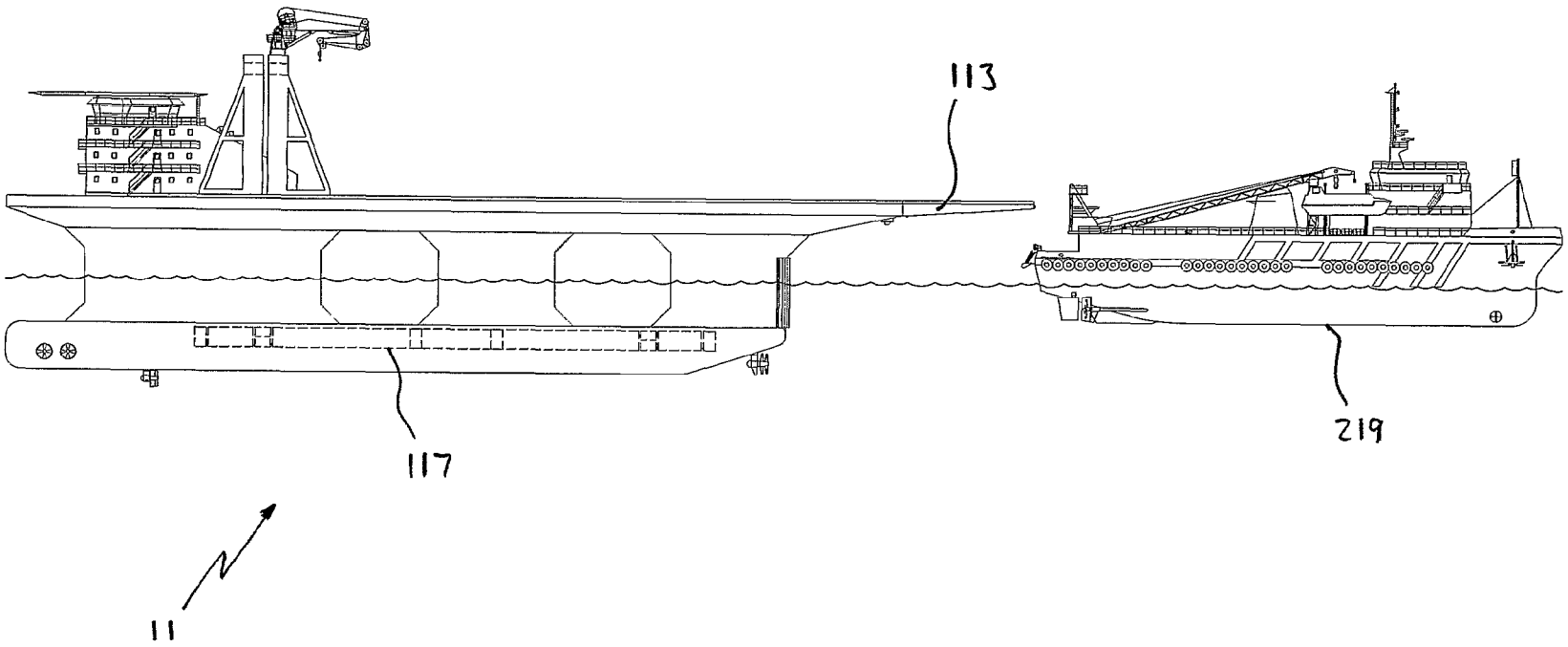
FIGS. 17 to 19 are a sequence of port-side views of the catamaran of FIG. 1, showing a loading and dry-dock transport sequence for recovery of a disabled vessel.
Figure 18:
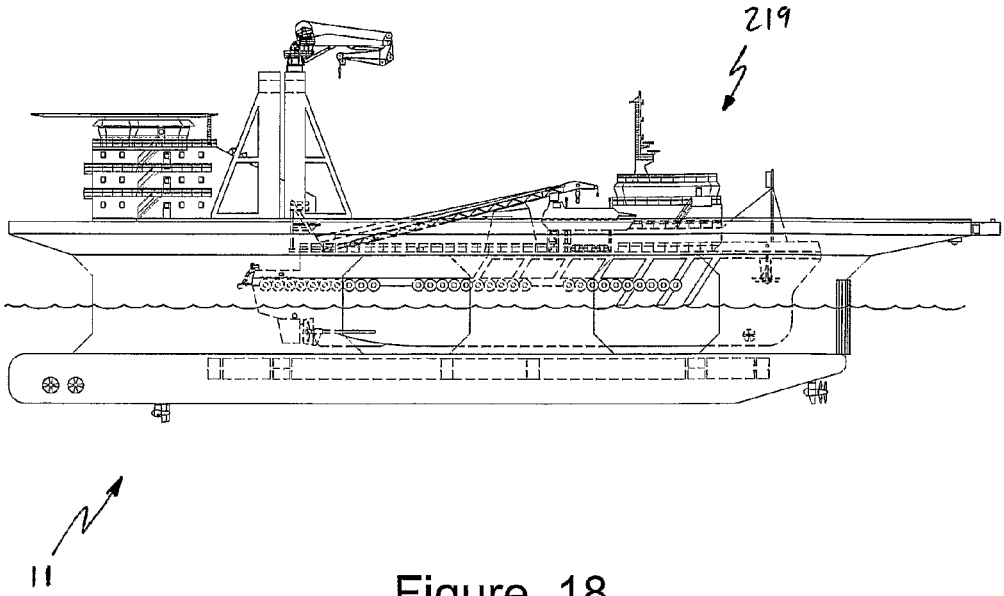
Figure 19:
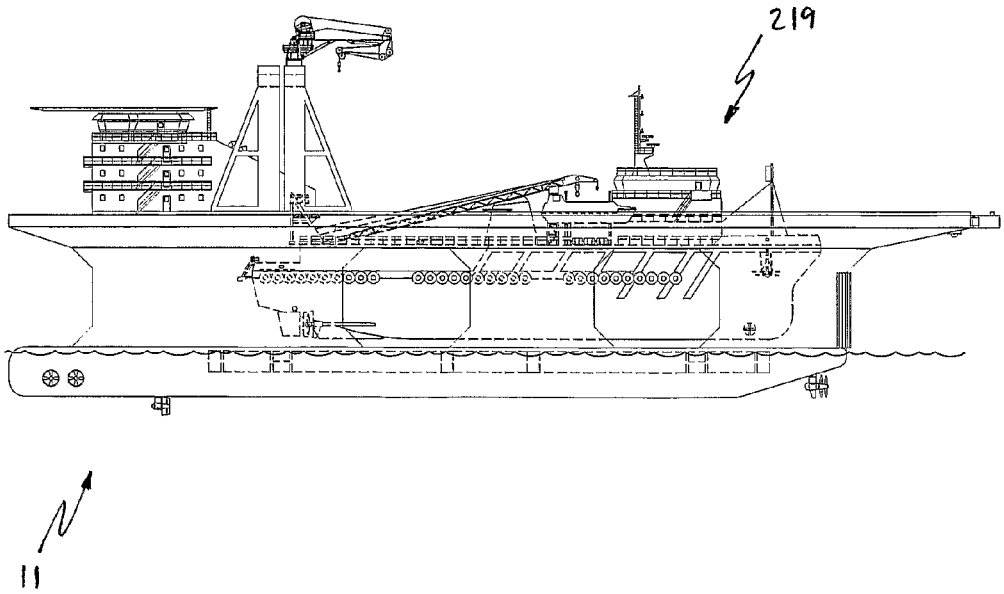

FIGS. 17 to 19 are a sequence of port-side views of the catamaran 11, showing a loading and dry-dock transport sequence for recovery of a disabled vessel 219. The catamaran incorporates a sub assembly in the form of a ship lifting cradle 117 of the type shown in FIG. 22. With ballast tanks flooded to give the catamaran 11 sufficient draft to allow the disabled vessel 219 to clear the ship lifting cradle 117, the catamaran is manoeuvred to receive the disabled vessel 219 on the ship lifting cradle 117 (see FIG. 18). The disabled vessel is then supported and blocked up on the ship lifting cradle 117, as the ballast tanks are pumped out, placing the disabled vessel in "dry-dock" configuration, as shown in FIG. 19.

Figure 20:
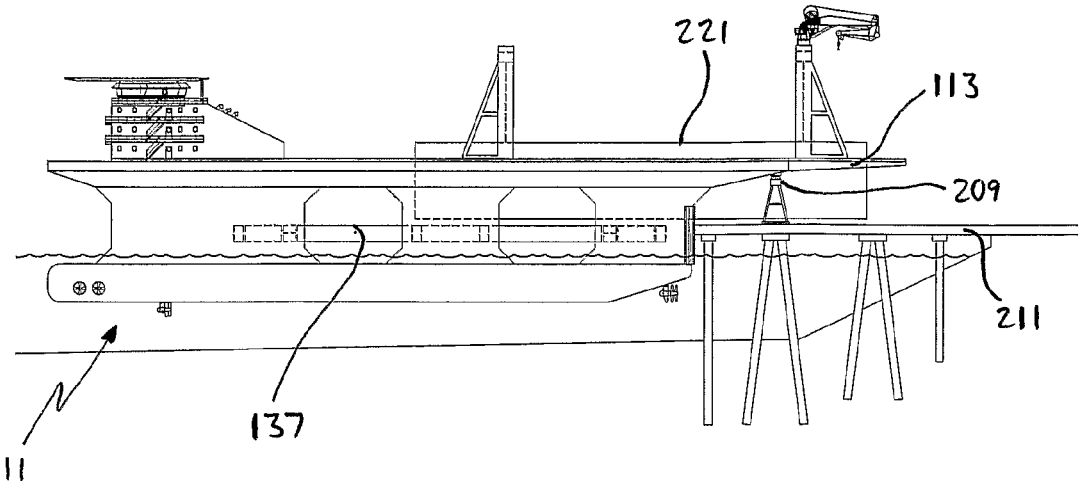
FIGS. 20 and 21 are a sequence of port-side views of the catamaran of FIG. 1, showing a loading of a container in a roll on/roll off operational mode.
Figure 21:
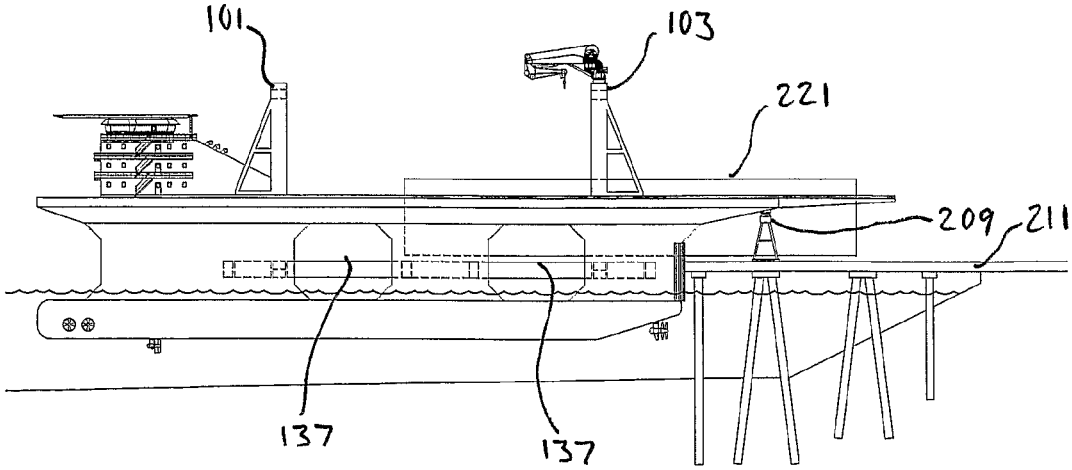

FIGS. 20 and 21 are a sequence of port-side views of the catamaran 11 docked to a wharf 211, showing a loading of a container 221 in a roll on/roll off operational mode. In this arrangement, the deck 137 of the sub assembly (as shown in FIG. 7) is used. The container 221 can be pushed on or off, with or without assistance of the gantries 101 and 103. A bridging section (not shown) is required between the wharf/bulkhead 211 and the deck 137 of the subassembly, to bridge the gap between the wharf/bulkhead 211 and the deck 137 while loading or unloading the container 221.

The catamaran has a length overall of 122 meters with length on the main deck of 115 meters, with the cantilevered deck portions 95, 97 providing 15 meters in length. The catamaran has a beam of 54.5 meters. The hull length, beam and depth are 100 meters, 11 meters and 7.5 meters. The approximate draft is 7 meters in "light ship" configuration, unladen with draft adjusting ballast tanks 133 empty; and 13 meters in operational configuration.

It should be appreciated that the scope of the invention is not limited to the particular embodiment described herein, and a person skilled in the art will be aware of what changes may be made without departing from the spirit and scope of the invention.

What is claimed is:

1. An ocean going transport vessel comprising a pair of longitudinal hulls spaced apart substantially parallel to each other, supporting a first deck portion located above said hulls, said first deck portion extending across said hulls and forming a structural link therebetween, said first deck portion being located toward one end of said hulls, above the normal operating waterline of said vessel; each said hull including a further deck portion extending at least from said first deck portion to the other end of said hulls, said hulls having a plurality of ballast tanks located therealong provided to allow adjustment of the draft and trim of said vessel, said hulls and said deck portions forming a U-shape when viewed from above and below, having a void extending between opposed said further deck portions and associated hulls, said void being provided for stowage or suspension of a load or subassembly in the form of a cradle, a frame, or a deck, wherein said further deck portions extend longitudinally beyond said hulls, supported in cantilever-type fashion as cantilevered deck portions which each include a docking point arranged to support the vessel by the cantilevered deck portions, by said docking point resting on a structural support.

2. An ocean going transport vessel as claimed in claim 1 wherein each said docking point is located on the underside of each said cantilevered deck portion.

3. An ocean going transport vessel as claimed in claim 1 wherein said docking point includes hydraulic height adjustment to adjust the load on the docking point and/or positioning of the cantilevered deck portions in response to vessel movement due to water movement or displacement variations caused by loading or unloading or in response to ballast tank adjustments.

4. An ocean going transport vessel as claimed in claim 3 wherein said docking point includes load monitoring at said docking point, feeding back to said hydraulic height adjustment, and also feeding back to control of ballast tank levels.

5. An ocean going transport vessel as claimed in claim 1 wherein the length of the void is at least two times the length of the first deck portion.

6. An ocean going transport vessel as claimed in claim 1 wherein said hulls each comprise a pontoon, and said first deck portion and said further deck portions are supported off said pontoons by structure extending between said deck portions and said pontoons.

7. An ocean going transport vessel as claimed in claim 6 wherein said structure comprises a plurality of caissons.

8. An ocean going transport vessel as claimed in claim 7 wherein said structure comprises three caissons extending from each said pontoon.

9. An ocean going transport vessel as claimed in claim 1 wherein said first deck portion provides a superstructure forming at least a bridge for said vessel and optionally workspace and accommodation for crew.

10. An ocean going transport vessel as claimed in claim 1 wherein the vessel includes at least one overhead gantry supported on and extending between the further deck portions for supporting hoists, cranes, for performing lifting and loading/unloading functions.

11. An ocean going transport vessel as claimed in claim 10 wherein said first deck portion and said further deck portions are contiguous, to allow said gantry to be run forward onto the first deck portion.

12. A loading system in combination with an ocean going transport vessel as claimed in claim 10, said loading system comprising providing in a wharf or at an open end of a dry dock, a structural support arranged in spaced configuration to support said cantilevered deck portions from underneath, said cantilevered deck portions being able to receive one or both of said gantries for loading and unloading said vessel.

13. A loading system in combination with an ocean going transport vessel as claimed in claim 12 wherein said structural support is arranged in spaced configuration to support said cantilevered deck portions from underneath contacts said docking point.

14. An ocean going transport vessel as claimed in claim 1 wherein the void is configured to removeably accommodate a subassembly which can be raised and lowered to a required height.

15. An ocean going transport vessel as claimed in claim 14 wherein said subassembly is carried in or on vertically extending tracks secured to said vessel located in spaced relation along the longitudinal extent of said void.

16. An ocean going transport vessel as claimed in claim 15 wherein said subassembly can be secured at different heights along said vertically extending tracks.

17. An ocean going transport vessel as claimed in claim 16 wherein said subassembly includes mechanisms arranged to engage with pins which extend in said vertically extending tracks.

18. An ocean going transport vessel as claimed in claim 17 wherein said pins are located recessed within said vertically extending tracks, and said mechanisms engaging with said pins also are locatable recessed within said vertically extending tracks, restraining said sub assembly against fore and aft movement.

19. An ocean going transport vessel as claimed in claim 14 wherein said subassembly includes removeable transverse bracing extending between and securable in opposed said vertically extending tracks.

20. An ocean going transport vessel as claimed in claim 1 wherein said vessel is provided with deck extensions which may be deployed to extend the further deck portions longitudinally beyond the longitudinal extent of said further deck portions (away from said first deck portion).

* * * * *